US007503792B2

(12) United States Patent
Xiao

(10) Patent No.: US 7,503,792 B2
(45) Date of Patent: Mar. 17, 2009

(54) ELECTRICAL CONNECTOR ASSEMBLY

(75) Inventor: Feng Xiao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/879,669

(22) Filed: Jul. 18, 2007

(65) Prior Publication Data

US 2008/0020621 A1 Jan. 24, 2008

(51) Int. Cl.
*H01R 13/62* (2006.01)

(52) U.S. Cl. ..... 439/326; 439/540.1

(58) Field of Classification Search ..... 439/326, 439/540.1, 541.5; 361/782–785, 802–803
See application file for complete search history.

(56) References Cited

U.S. PATENT DOCUMENTS

| | | | | |
|---|---|---|---|---|
| 5,956,835 | A * | 9/1999 | Aksu | 29/468 |
| 6,468,101 | B2 | 10/2002 | Suzuki | |
| 6,768,642 | B2 * | 7/2004 | Hines et al. | 361/721 |
| 6,801,440 | B2 * | 10/2004 | Inoue et al. | 361/803 |
| 6,821,144 | B2 * | 11/2004 | Choy | 439/541.5 |
| 7,021,953 | B2 | 4/2006 | Kawamae | |
| 7,085,141 | B2 * | 8/2006 | Yi | 361/804 |
| 7,300,298 | B2 * | 11/2007 | Kameda | 438/326 |
| 7,300,299 | B2 * | 11/2007 | Wang | 439/326 |

FOREIGN PATENT DOCUMENTS

| | | |
|---|---|---|
| TW | M261882 | 4/2005 |
| TW | M283401 | 12/2005 |

* cited by examiner

*Primary Examiner*—Thanh-Tam T Le
(74) *Attorney, Agent, or Firm*—Wei Te Chung

(57) ABSTRACT

An electrical connector assembly (1) for connecting electrically plural cards to a PCB (3) includes at least one first connector (10) and at least one first latch (11) for positioning at least one first card (4) therebetween in a parallel relation with the PCB in which a first card inserting direction and a first card positioning position are defined; at least one second connector (20) and at least one second latch (21) for positioning at least one second card (5) therebetween in a parallel relation with the PCB in which a second card inserting direction and a second card positioning position are defined; the first card inserting direction is intersectant with the second card inserting direction; and the first card positioning position and the second card positioning position are in different levels above the PCB.

13 Claims, 6 Drawing Sheets

ELECTRICAL CONNECTOR ASSEMBLY

BACKGROUND

1. Field of the Invention

The invention relates to an electrical connector assembly, and particularly to an electrical connector assembly connecting plural cards to a printed circuit board.

2. The Related Art

U.S. Pat. No. 7,021,953 discloses a card edge connector latch which makes it possible to install card or cards side by side at a high density on a motherboard. The card edge connector latch is used together with a card edge connector that is mounted on a motherboard. The latch comprises board fasteners which are fastened to the motherboard, and latches which latch an opposite end portion of the card, a contact end portion of which is received in the card edge connector, in a state in which the card is substantially parallel to the motherboard. The latch is carried on and fastened to the motherboard opposite the card edge connector without being assembled with the card edge connector. This design allows plural cards are installed side by side at a high density. Anyhow, a big area is occupied by the card edge connectors, the cards and the latches above the motherboard when plural cards, especially three or more cards are installed side by side.

Therefore, it is desired to have an improved electrical connector assembly to overcome the disadvantages of the prior art.

SUMMARY OF THE INVENTION

Accordingly, an object of the present invention is to provide an electrical connector assembly occupying a lesser space above a printed circuit board.

To achieve the above-mentioned object, the invention is to provide an electrical connector assembly for connecting electrically plural cards to a printed circuit board, the electrical connector assembly comprising at least one first connector and corresponding at least one first latch for positioning at least one first card therebetween in a parallel relation with the printed circuit board in which a first card inserting direction and a first card positioning position are defined; at least one second connector and corresponding at least one second latch for positioning at least one second card therebetween in a parallel relation with the printed circuit board in which a second card inserting direction and a second card positioning position are defined; the first card inserting direction being intersectant with the second card inserting direction; and the first card positioning position and the second card positioning position are in different levels above the printed circuit board.

Other objects, advantages and novel features of the present invention will become more apparent from the following detailed description of the present embodiment when taken in conjunction with the accompanying drawings.

DETAILED DESCRIPTION OF THE PREFERRED EMBODIMENT

Figure 1:
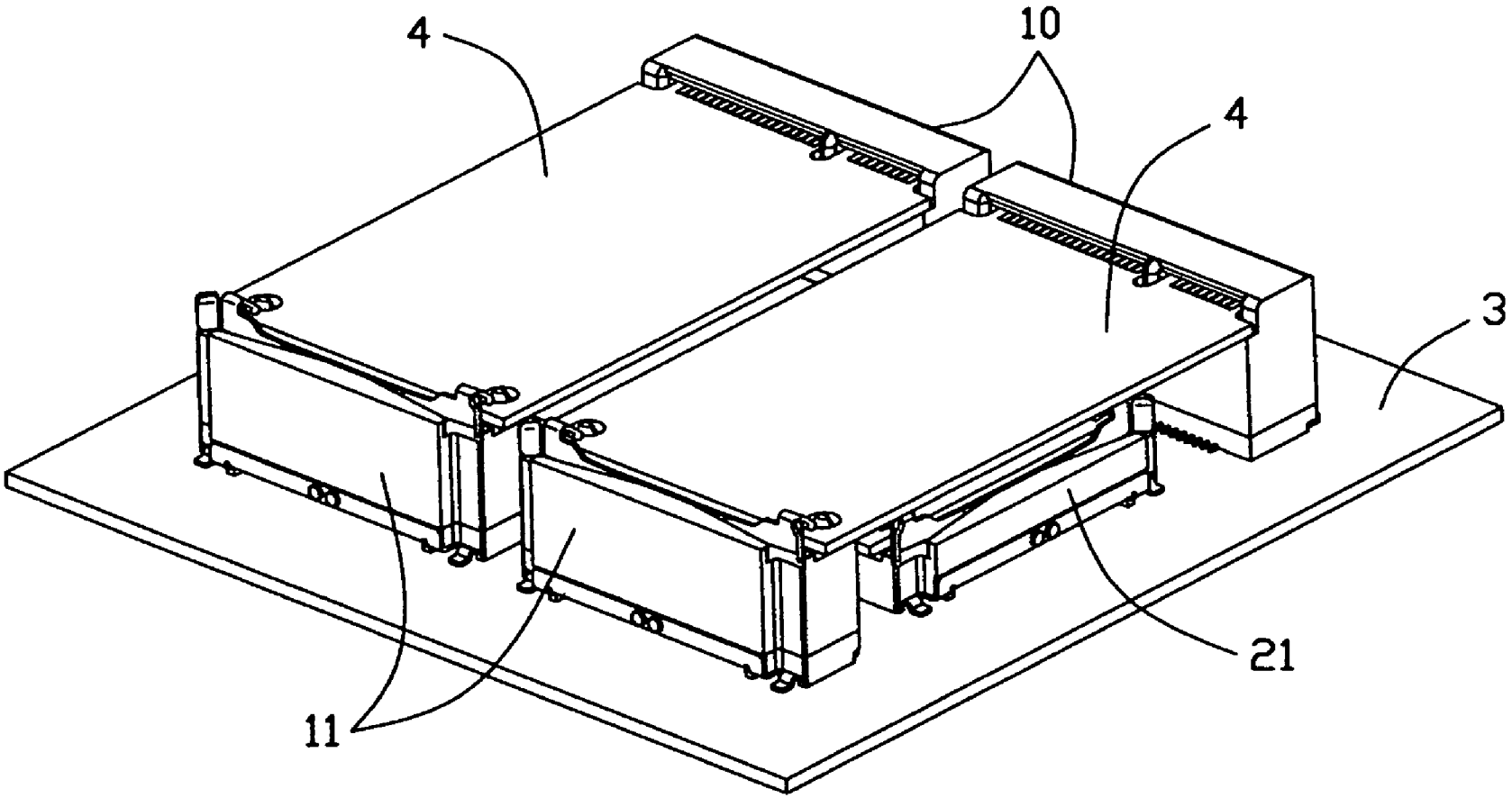
FIG. 1 is an assembled, perspective view of an electrical connector assembly in accordance with a preferred embodiment of the present invention.

References will now be made to the drawing figures to describe the preferred embodiment of the present invention in detail.

Figure 2:
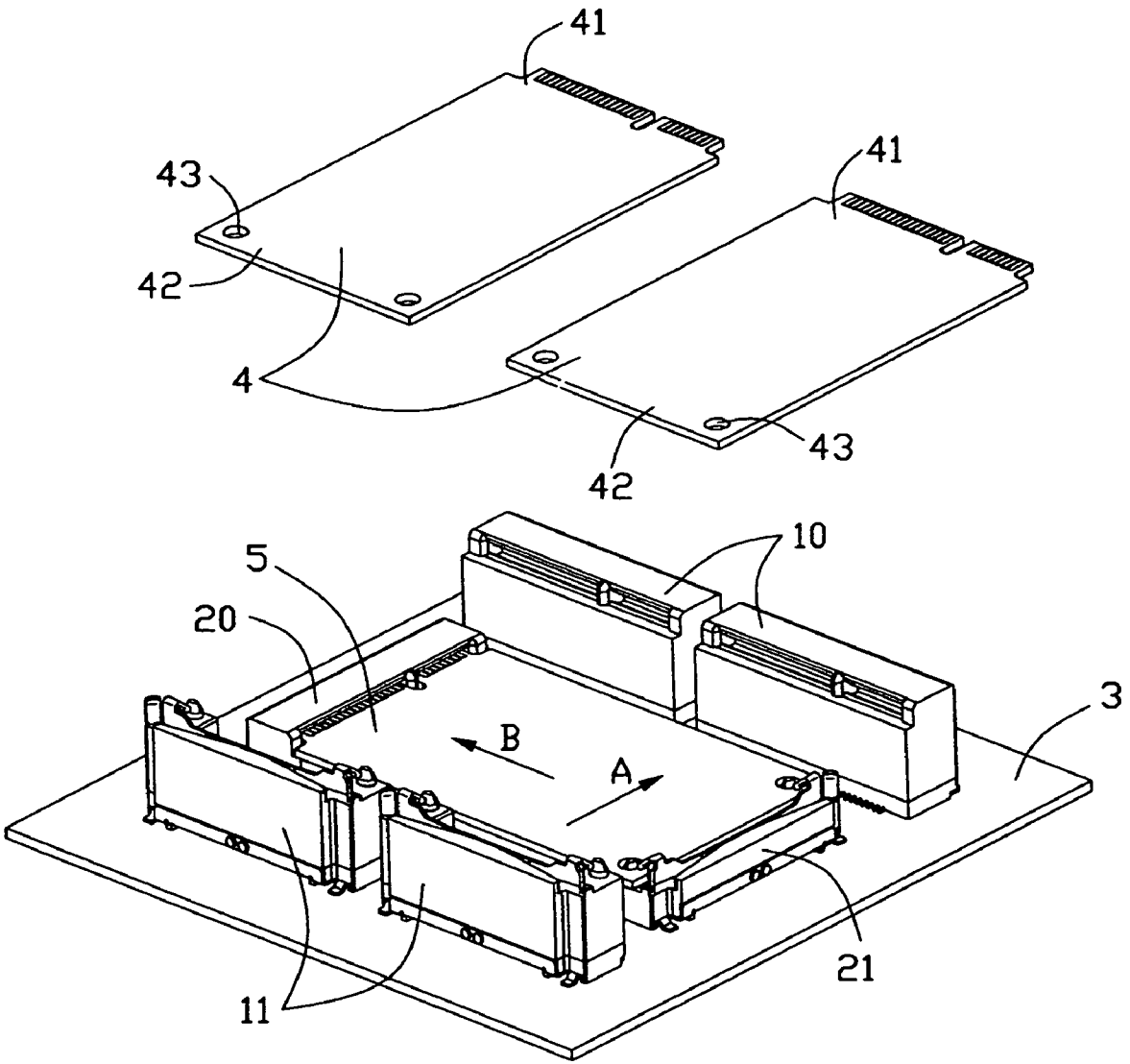
FIG. 2 an exploded, perspective view of the electrical connector assembly shown in FIG. 1, wherein two cards are detached therefrom.
Figure 3:
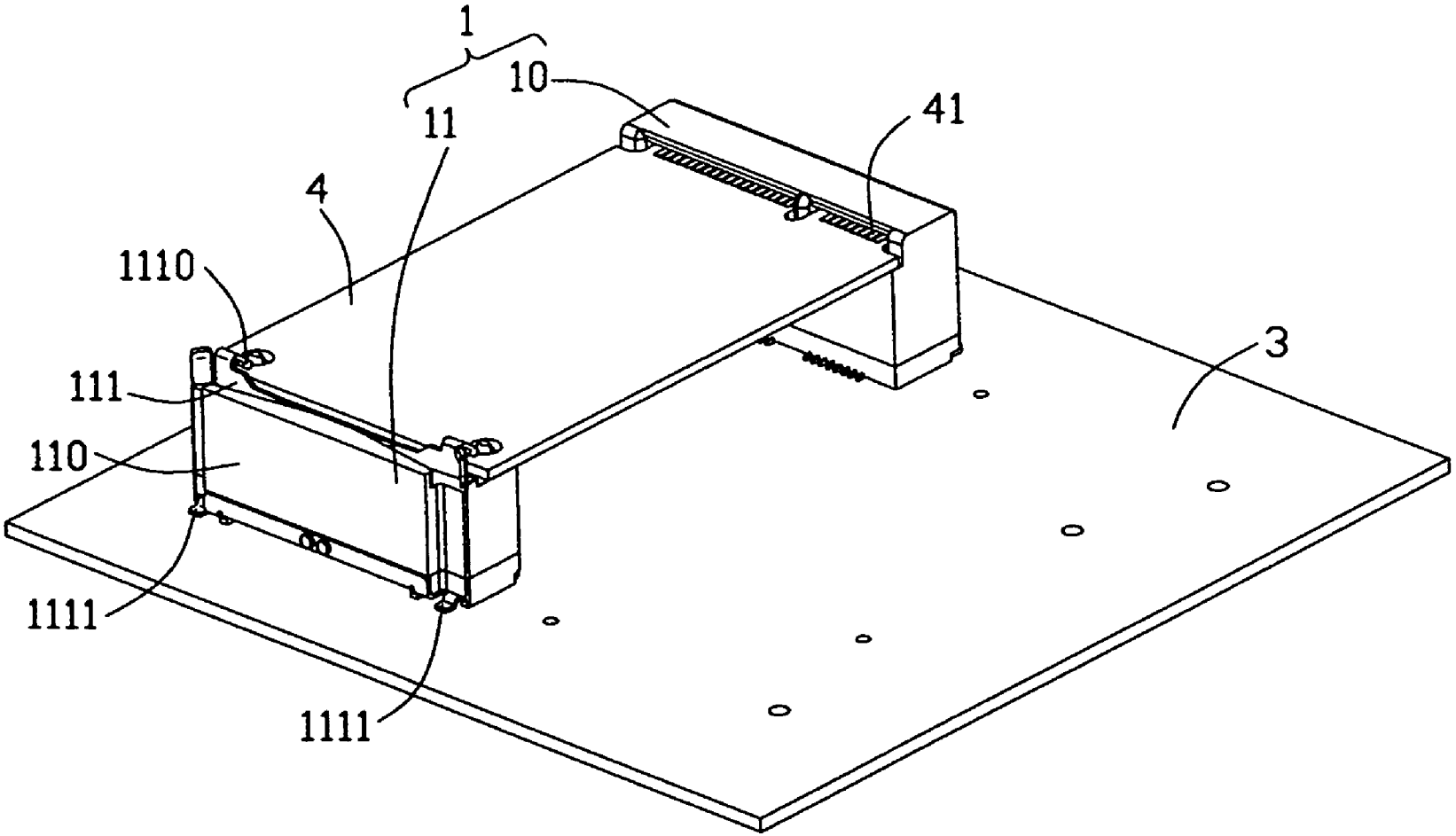
FIG. 3 is a perspective view of the first connector assembly.
Figure 4:
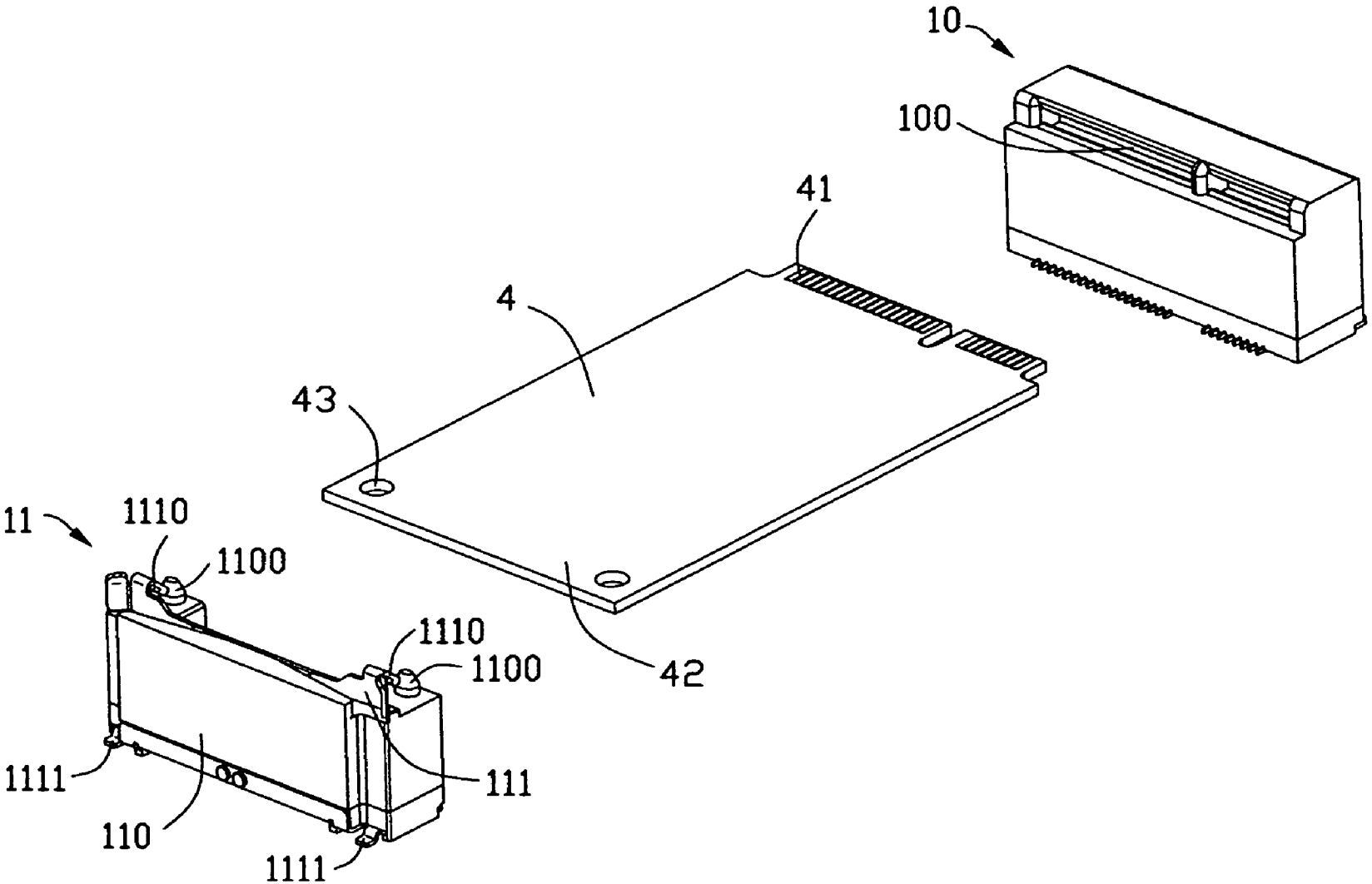
FIG. 4 is an exploded, perspective view of the first connector assembly of FIG. 3.

It will be noted here that for a better understanding, most of like components are designated by like reference numerals throughout the various figures in the embodiments. Referring to FIGS. 1-3, a pair of first electrical connector assembly 1 with a pair of first cards 4 received therein and a second electrical connector assembly 2 with one second card 5 received therein are commonly mounted to a PCB (printed circuit board) 3.

Referring to FIGS. 1-3, the pair of first electrical connector assemblies 1 which have the same structure, comprise a pair of first electrical connector 10 and a pair of first latches 11 mounted side by side on the PCB 3, so that the pair of first cards 4 are mounted side by side on the PCB 3. The first latch 11 is fastened to the PCB 3 opposite the first electrical connector 10 without being assembled with the first electrical connector 10. The first electrical connector 10 locates on a first area of the PCB 3, the first latch 11 locates on a second area of the PCB 3 opposite to the first area, and the first card 4 is positioned between the first and second areas in a parallel relation with the PCB 3. The first electrical connector 10 defines a first slot 100 along lengthwise direction thereof for holding a front rim 41 of the first card 4. Each first latch 11 includes a first base 10, a first metal part 111 and a first mounting part 1111, wherein the first base 110 extends upwardly a pair of positioning posts 1100 at opposite ends therefrom for coupling to a pair of positioning holes 43 of the first card 4. The first metal part 111 is provided with two hook sections 1110 located at the opposite distal ends thereof and extending toward the first electrical connector 10 with an oblique upward guiding face thereon. The mounting part 1111 extends out of the first base 110 for mounting to the corresponding pads (not shown) of the PCB 3. The first card 4 has plural pads (not labeled) on the top and bottom faces thereof around the front rim 41.

During assembling, the front rim 41 of the first card 4 is inserted initially into the first slot 100 of the first electrical connector 10, and a rear rim 42 of the first card 4 is successively downwardly moved toward the passing the hook sections 1110 wherein the first metal part 111 is elastically rearwardly deflected. At the same time, the first card 4 is correctly positioned relative to the PCB 3 via the positioning posts 1100 extending through the positioning hole 43 in a stable downward movement. When the rear rim 42 of the first card 4 completely passes the hook sections 1110, the metal part 111 resumes the original position to have the hook sections 1110 downwardly press the rear rim 42 of the first card 4. After assembled, between the first electrical connector 10 and the first latch 11, a first card inserting direction A is defined. Under this condition, a first card positioning position is defined in which the first card 4 is in parallel with the PCB 3.

Figure 5:
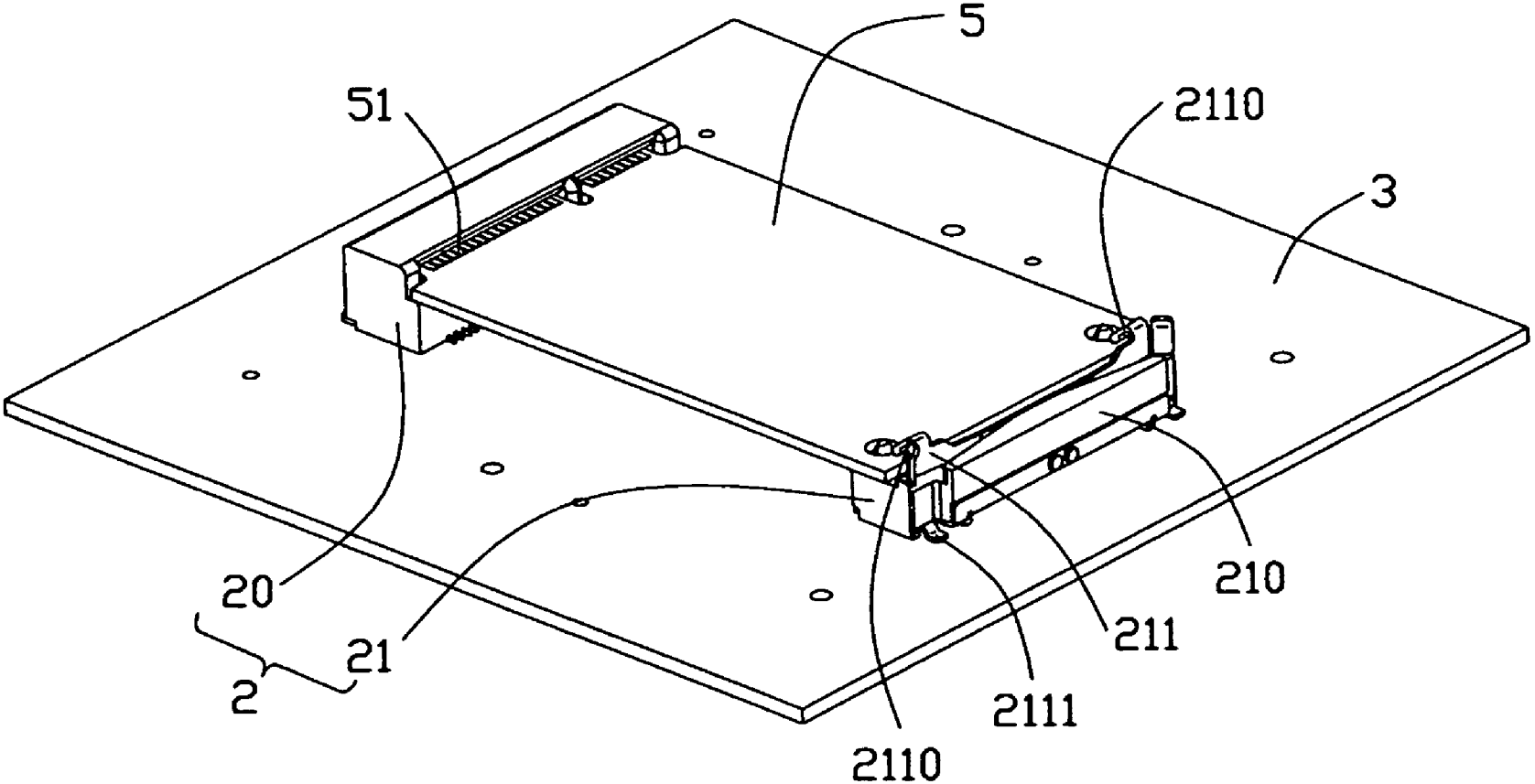
FIG. 5 is a perspective view of the second connector assembly.
Figure 6:
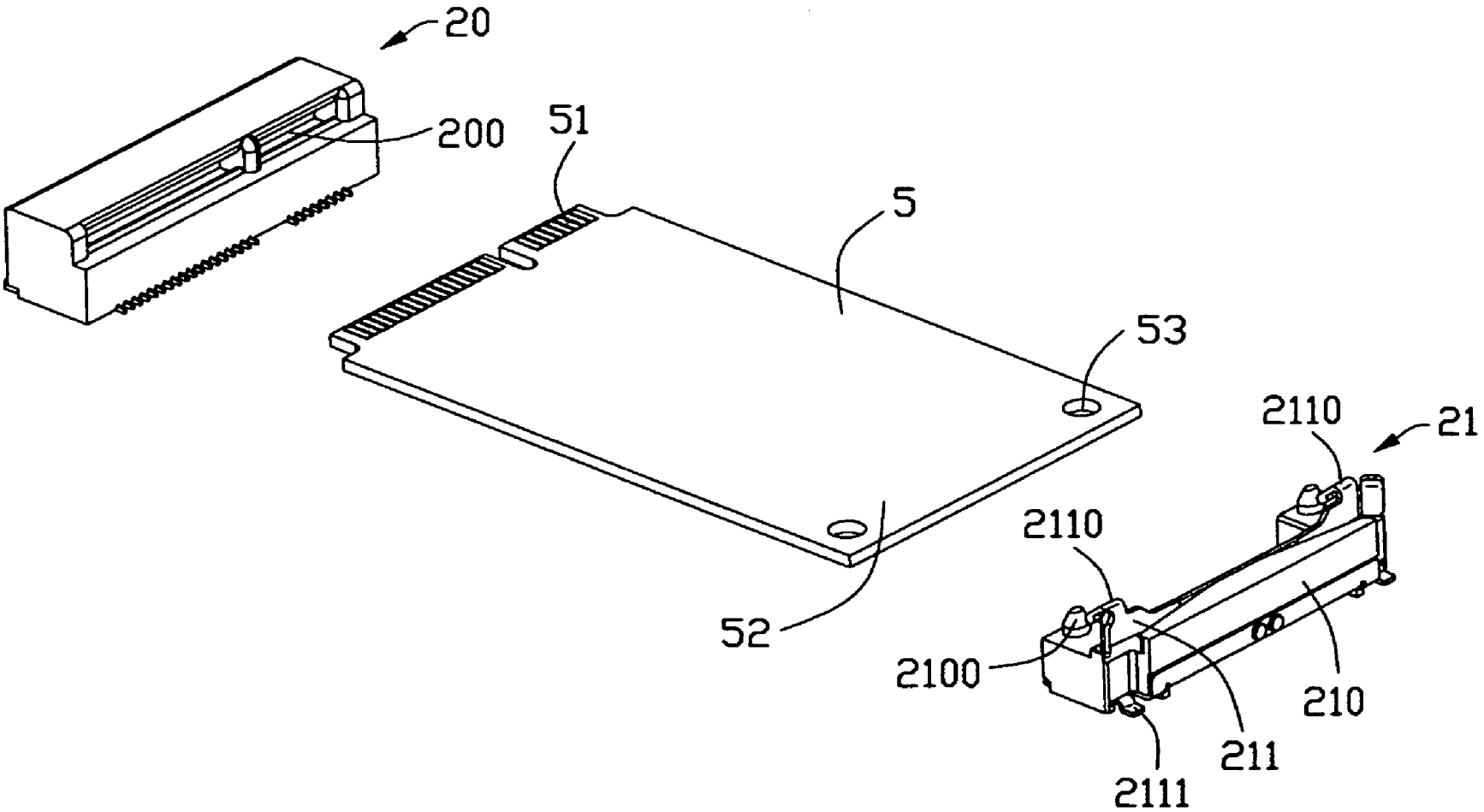
FIG. 6 is an exploded, perspective view of the second connector assembly of FIG. 5.

Referring to FIGS. 2, 5-6, the second electrical connector assembly 2 comprises a second electrical connector 20 and a second latch 21 mounted on the PCB 3, so that the second card 5 is mounted on the PCB 3. The second latch 21 is fastened to the PCB 3 opposite the second electrical connector 20 without being assembled with the second electrical connector 20.

The second electrical connector 20 locates on a third area of the PCB 3, the second latch 21 locates on a forth area of the PCB 3 opposite to the third area, and the second card 5 is positioned between the third and forth areas in a parallel relation with the PCB 3. The second electrical connector 20 defines a second slot 200 along lengthwise direction thereof for holding a front rim 51 of the first card 5. Each second latch 21 includes a second base 210, a second metal part 211 and a second mounting part 2111, wherein the second base 210 extends upwardly a pair of positioning posts 2100 at opposite ends therefrom for coupling to a pair of positioning holes 53 of the second card 4. The second metal part 211 is provided with two hook sections 2110 located at the opposite distal ends thereof and extending toward the second electrical connector 20 with an oblique upward guiding face thereon. The second mounting part 2111 extends out of the second base 210 for mounting to the corresponding pads (not shown) of the PCB 3. The second card 5 has plural pads (not labeled) on the top and bottom faces thereof around the front rim 51.

During assembling, the front rim 51 of the second card 5 is inserted initially into the second slot 200 of the second electrical connector 20, and a rear rim 52 of the second card 5 is successively downwardly moved toward the passing the hook sections 2110 wherein the second metal part 211 is elastically rearwardly deflected. At the same time, the second card 5 is correctly positioned relative to the PCB 3 via the positioning posts 2100 extending through the positioning hole 53 in a stable downward movement. When the rear rim 52 of the second card 5 completely passes the hook sections 2110, the second metal part 211 resumes the original position to have the hook sections 2110 downwardly press the rear rim 52 of the second card 5. After assembled, between the second electrical connector 20 and the second latch 21, a second card inserting direction B is defined. Under this condition, a second card positioning position is defined in which the second card 5 is in parallel with the PCB 3.

Referring to FIGS. 1-2, the pair of first connectors 10 and the pair of first latches 11 is higher than the second connector 20 and the second latch 21 above the PCB 3 so that the first card positioning position is higher than the second card positioning position. The second connector 20 locates between one of first connector 10 and the corresponding first latch 11, the second latch 21 locates between another first connector 10 and the corresponding first latch 11, and the first card inserting direction A intersectant the second card inserting direction B at right angle. Under this condition, the first cards 4 is located above the second card 5 on the PCB 3.

More than one second electrical connector assemblies including more than one second connectors and latches may position under the pair of first electrical connector assemblies, when the length of the first cards between the first connectors and latches are enough. Understandably, the second connector and latch may be higher than the pair of first connectors and latches, and the pair of first connectors and latches locate between the second connector and latch, when the length of the second card between the second connector and latch is enough. Correspondingly, the second card positioning position may be higher than the first card positioning position on the PCB, thus the second card is located above the first card on the PCB.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of ordinary skill in this field are to understand that all such equivalent structures are to be included within the scope of the following claims.

I claim:

1. An electrical connector assembly comprising:

a printed circuit board (PCB);

a first connector and a first latch mechanism respectively positioned upon the PCB and spaced from each other in a first direction; and a second connector and a second latch mechanism respectively positioned upon the PCB and spaced from each other in a second direction different from and angled with regard to the first direction;

a first space defined between the first connector and the first latch mechanism and a second space defined between the second connector and the second latch mechanism are overlapped with each other in a vertical direction perpendicular to both said first direction and said second horizontal direction;

wherein a first card is pivotally assembled to and retainably received in the first space by means of both said first connector and first latch mechanism, and a second card is pivotally assembled to and retainably received in the second space by means of both said second connector and the second latch mechanism, under a condition that the first card mechanically and electrically connected to the first connector is located at a first level, and the second card mechanically and electrically connected to the second connector is located at a second level which is lower than the first level.

2. The electrical connector assembly as claimed in claim 1, wherein the first connector is higher than the second connector while the first connector and the second connector are spaced from each other without overlapping in the vertical direction.

3. The electrical connector assembly as claimed in claim 2, wherein both said first connector and said second connector have a similar configuration and dimension in a top view.

4. The electrical connector assembly as claimed in claim 1, wherein the first connector and the first latch mechanism are respectively located by two sides of the second space.

5. The electrical connector assembly as claimed in claim 1, wherein there are side by side two of said first connector and said first latch mechanism defining two of said first space which are roughly equally overlapped with corresponding portions of the second space along the second direction.

6. The electrical connector assembly as claimed in claim 1, wherein said first direction is angled with regard to the second direction at 90 degrees.

7. The electrical connector assembly as claimed in claim 1, wherein said second card passes the first level during installation into the second space.

8. An height rise connector assembly comprising:

a printed circuit board (PCB);

an electrical connector and a latch mechanism respectively mounted on the PCB and spaced from each other with a space defined therebetween in a first direction, said latch mechanism defining an inner side facing toward the space and an outer side opposite to the space;

a card pivotally installed into and retainably received in the space by means of said connector and said latch mechanism; wherein the connector is raised at a level which allows another similar card to be pivotally assembled and retained under said card by another connector and another latch mechanism both of which define another space therebetween in a second direction different from the first horizontal direction, under a condition that said another card is lower than the card, and said another latch mechanism is not located on the outer side but on the inner side;

wherein said another card is angled with the card at a top view.

9. The electrical connector assembly as claimed in claim 8, wherein said first direction is 90 degrees angled with regard to the second direction.

10. The electrical connector assembly as claimed in claim 8, wherein said another card passes the level during installation into said another space.

11. An electrical connector assembly adapted for being mounted on a printed circuit board (PCB) comprising:

two first connectors positioned side by side and two corresponding first latch mechanisms positioned side by side, each first connector and the corresponding first latch mechanism respectively positioned upon the PCB and spaced from each other in a first direction; and a second connector and a second latch mechanism respectively positioned upon the PCB and spaced from each other in a second direction angled with the first direction; wherein a first space is defined between the first connectors and the corresponding first latch mechanisms, a second space defined between the second connector and the second latch mechanism and the each first connector and the each corresponding first latch mechanism are respectively located by two sides of the second space; and wherein first two cards are pivotally assembled to and retainably received in the first space by means of both said two first connectors and first latch mechanisms, and a second card is pivotally assembled to and retainably received in the second space by means of both said second connector and the second latch mechanism, under a condition that the first cards mechanically and electrically connected to the first connectors are located at a first level, and the second card mechanically and electrically connected to the second connector is located at a second level which is lower than the first level.

12. The electrical connector assembly as claimed in claim 11, wherein the first connector and the second connector are spaced from each other without overlapping in the vertical direction.

13. The electrical connector assembly as claimed in claim 12, wherein said first connectors and said second connector have a similar configuration and dimension in a top view.

* * * * *